US006074239A

United States Patent [19]

Camps

[11] Patent Number: 6,074,239

[45] Date of Patent: Jun. 13, 2000

[54] DEVICE FOR CONNECTING LINES BY INSULATION-DISPLACING CONTACTS

[75] Inventor: Didier Camps, Chemin Guillet, France

[73] Assignee: Pouyet, S.A., France

[21] Appl. No.: 09/183,463

[22] Filed: Oct. 30, 1998

[30] Foreign Application Priority Data

Nov. 3, 1997 [FR] France ..... 97 14176

[51] Int. Cl.[7] ..... H01R 4/24; H01R 4/26; H01R 11/20

[52] U.S. Cl. ..... 439/409; 439/922

[58] Field of Search ..... 439/409, 410, 439/395, 417, 404, 922

[56] References Cited

U.S. PATENT DOCUMENTS 2,802,083 8/1957 Lapeyre ..... 439/409
5,681,182 10/1997 Reichle ..... 439/417

*Primary Examiner*—Lincoln Donovan
*Assistant Examiner*—Javaid Nasri
*Attorney, Agent, or Firm*—Richard P. Gilly

[57] ABSTRACT

This invention relates to a device for connecting a sheathed electric wire in an insulation-displacing contact with the aid of a pivoting connection pusher. When the rotary pusher is opened after the wire is connected, a "semi-hard" point is passed by reason of a cam which pushes an elastic switch element, then the pusher is maintained in its position of maximum opening by a hollow in the cam, while the line connection then remains cut off by the effect of this cam.

7 Claims, 4 Drawing Sheets

DEVICE FOR CONNECTING LINES BY INSULATION-DISPLACING CONTACTS

FIELD OF THE INVENTION

The present invention relates to a device for connecting one or more electric wires incorporating a sheathed conducting core, this device employing one or more insulation-displacing contacts, also known as "I.D.C.'s".

BACKGROUND OF THE INVENTION

When a line, for example an incoming bifilar telephone line, is connected to a corresponding number of insulation-displacing contacts, such connection is often effected on a connector which must be able to present a cut-off point, constituted in this example by two punctual elastic contacts, in order to be able easily to insulate this incoming line from the outgoing line to which it is thus connected, this being necessary for testing, maintenance or repair works.

The known method consists in plugging on the connector an insulation plug, or test plug, which separates these punctual elastic contacts, this making it possible to insulate the incoming line from the outgoing line. This modus operandi, which necessitates having such an insulation or test plug available, proves impractical in situ, especially if it is question of lines other than telephone lines, for example remote-transfer lines for installations taking energy consumption measurements.

It is an object of the present invention to overcome this drawback.

SUMMARY OF THE INVENTION

To that end, the invention relates to a device for connecting one or more sheathed electric wires by driving said wires, by means of a rotary pusher of the pivoting cap type, into corresponding receiver insulation-displacing contacts, or "I.D.C.'s", these insulation-displacing contacts each being, in this connection device, electrically connected to a corresponding line connection, characterized in that:

- at least one of these insulation-displacing contacts is connected within this device, to the line connection associated therewith, via an elastic cut-off contact,
- and the opening of this elastic cut-off contact is provoked by the opening of said rotary pusher, by means of a cam consequently actuated by this maneuvering of opening of the rotary pusher.

Said cam and elastic contact are advantageously shaped so that, by thrust of this elastic contact by the cam beyond its point of opening, then fall, at the end of stroke of opening of the rotary pusher, of this elastic contact into a smooth locking cavity of the pusher in its position of maximum opening, this rotary pusher is finally maintained, after passage of a "semi-hard" point created by an excess of elastic thrust of the cut-off contact, in its position of maximum opening, and, by the reverse maneuvering, then closing again on passing through this "semi-hard" point again and re-establishing closure of said elastic contact.

BRIEF DESCRIPTION OF THE DRAWINGS

The invention will be more readily understood on reading the following description of a non-limiting embodiment of this line insulation device applied by way of example to a terminal block for shunting electric lines, with reference to the accompanying drawings, in which.

DESCRIPTION OF PREFERRED EMBODIMENT

Figure 1:
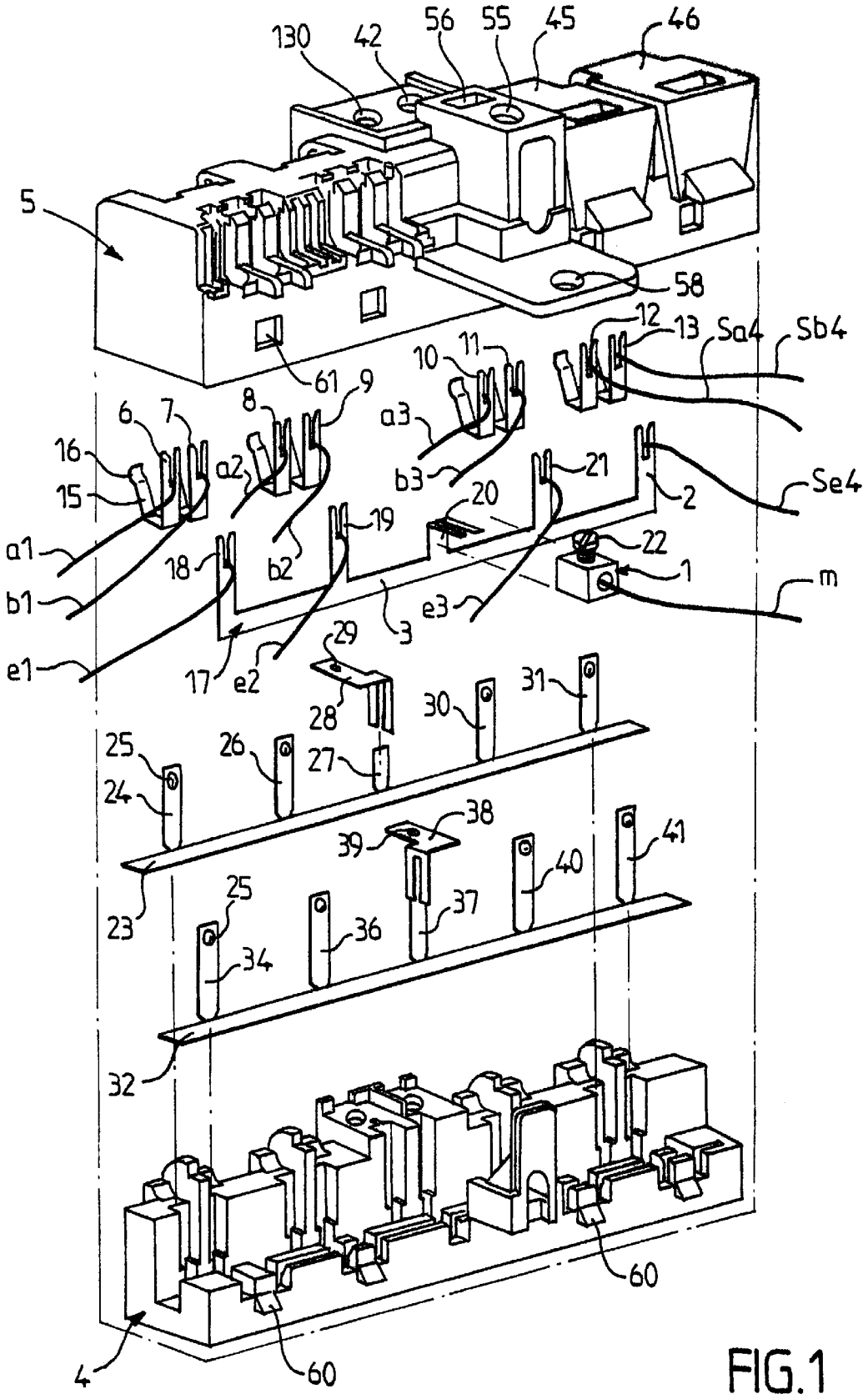
FIG. 1 is an overall view, in partially exploded perspective, of this shunting terminal block, with two rotary pushers removed and two rotary pushers closed.
Figure 2:
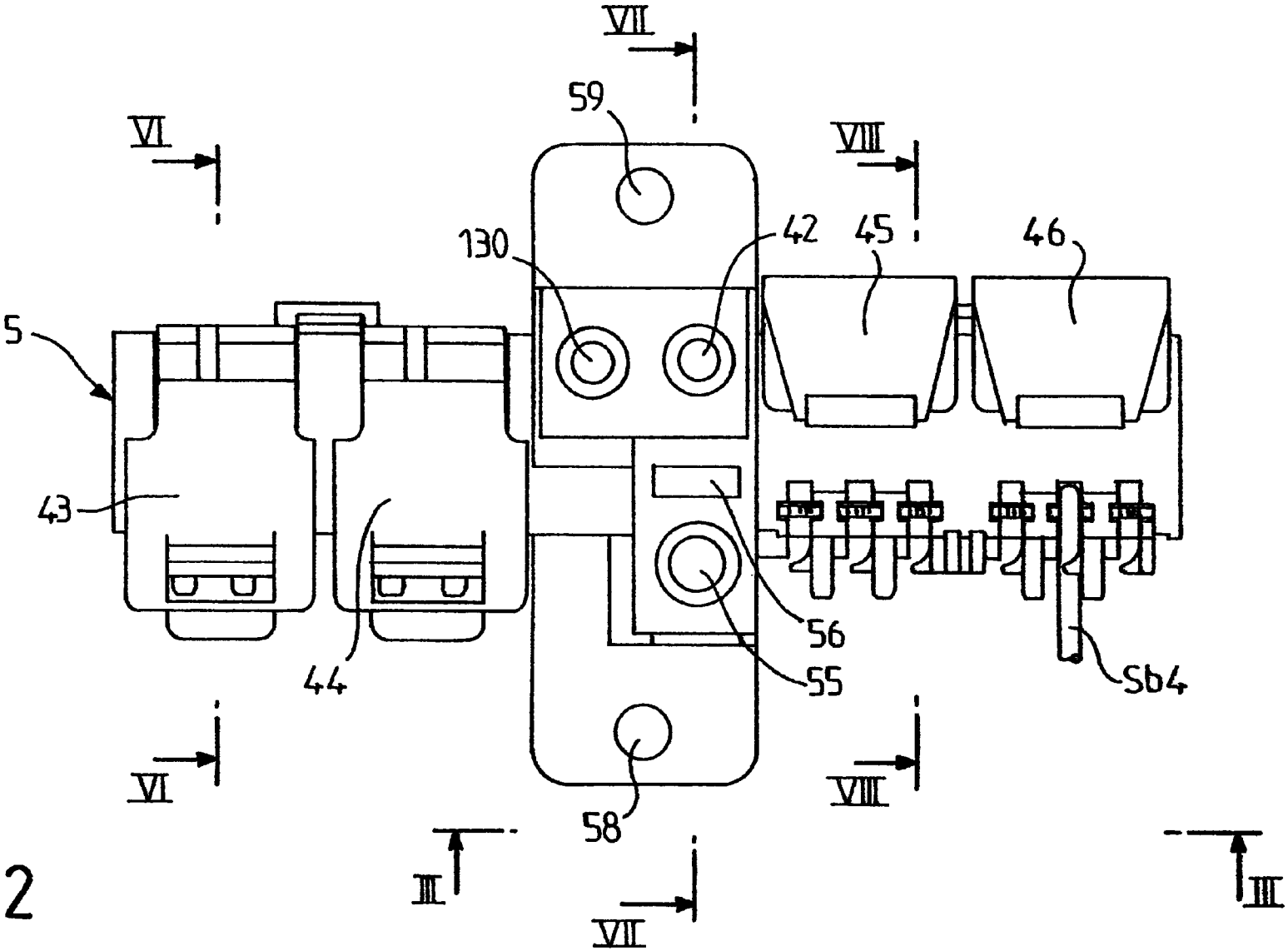
FIG. 2 is a plan view of this same terminal block with two pushers open and two pushers closed.
Figure 3:
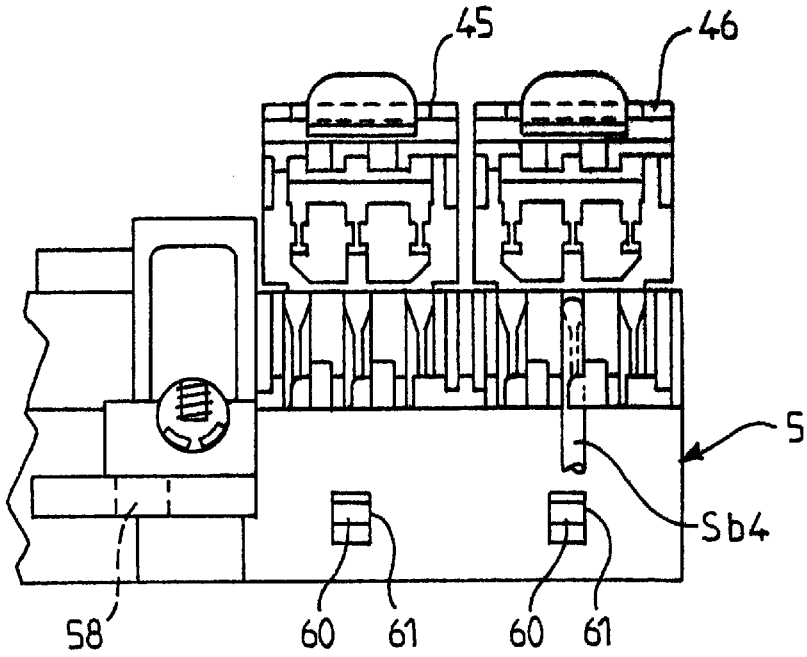
FIG. 3 is a partial front view of the terminal block of FIG. 1.

Referring now to the drawings, and firstly to FIGS. 1 to 3 and 6, it is question of a terminal block for shunting a maximum of four electric lines, each line, such as for example line (a1, b1, e1), being composed (FIG. 1) of two line wires a1 and b1 and of a screen wire e1.

By its own set of connectors, the terminal block effects the shunt of three lines, and the common line thus obtained is extracted from the terminal block and, for example, connected on another terminal block of the same type, by the three respective output wires:

- Sa4 corresponding to the placing of the three incoming wires a1, a2, a3 in parallel,
- Sb4 corresponding to the placing of the three incoming wires b1, b2, b3 in parallel,
- and the screen wire Se4, corresponding to the placing of the three screen wires e1, e2, e3 in parallel and which, as is the case for all the other screen wires, is connected with the ground of the installation by the ground wire m.

As is shown in the drawings, insulation-displacing contacts, or I.D.C.'s, are used for effecting the connection, on the terminal block, of the incoming wires a1, b1, e1, etc . . . and for effecting the connection, on this terminal block, of the two outgoing line wires Sa4, Sb4 and Se4.

On the other hand, the ground wire m generally being larger than the other wires, it is connected on the terminal block by a screw connector 1. This is, moreover, optional, as, if it were finer, this ground wire might equally well be connected on the I.D. contact 20 of the ground comb 17 which will be described hereinbelow. This I.D. contact 20 would in that case not need to be bent at 90 degrees as shown in FIG. 1.

As shown in FIG. 1, this terminal block is composed of two bodies, a base 4 and a cover 5, made of plastics material which fit on each other by clipping, these two bodies being shaped to receive the various metal elements which constitute the whole set of connectors for receiving and shunting:

Four pairs of I.D.C. contacts for receiving the line wires:

- a first pair 6, 7 for receiving the line wires a1, b1,
- a second pair 8, 9 for receiving the line wires a2, b2,
- a third pair 10, 11 for receiving the line wires a3, b3,
- and a fourth pair 12, 13 for receiving the outgoing line wires Sa4, Sb4 towards, for example, another terminal block of the same type.

It should be noted that each of these I.D. contacts is in the form of a U, in that it extends rearwardly by an elastic part 15 of which the free end 16 forms an elastic contact flat of rounded shape and convex towards the outside of the U that the contact forms.

A ground comb 17 constituted by a transverse bar 3 and five teeth in the form of I.D. contacts;

- a first I.D. contact 18 for receiving the screen wire e1 associated with the first incoming line a1, b1,
- a second I.D. contact 19 for receiving the screen wire e2 associated with the second incoming line a2, b2,
- a third I.D. contact 20 which is median and is constructed in the present case in the form of an I.D. contact only for reasons of convenience of manufacture, as it is in fact bent as shown in order to receive (FIGS. 1 and 7), the piece 1 for connecting the ground wire m by the screw 22.

a fourth I.D. contact 21 for receiving the screen wire e3 which is associated with the third incoming line a3, b3, a fifth I.D. contact 2 which receives the screen wire Se4 of the outgoing line towards, for example, another terminal block.

A transverse bar 23 for shunting the first wires a1, a2, b2, Sa4, of the three incoming lines and of the outgoing line mentioned above.

This bar 23 extends by four teeth which are orthogonal to its plane and which are regularly distributed as shown in FIG. 1:

a first tooth 24 of which the free end comprises a rounded part 25 (FIGS. 1 and 6) intended to form a contact stud with the conjugate free end of the elastic rear arm 15 of the I.D. contact 6 relative to the line wire a1, a second tooth 26 associated in the same way with the elastic rear arm of the I.D. contact 8 relative to the line wire a2, a median tooth 27 which is not associated with any line, but which receives a tuning fork contact 28 whose shape is visible in FIG. 1 and of which the free end is pierced with an orifice 29 for receiving a first test plug which may be introduced through a corresponding orifice 30 in the upper part of the cover 5 of the terminal block, a fourth tooth 30 associated, in the same manner as for teeth 24 and 26, with the elastic rear arm of the I.D. contact 10 relative to the line wire a3, and a fifth tooth 31 associated, in the same manner, with the elastic rear arm of the I.D. contact 12 relative to the first outgoing line wire Sa4.

Another transverse bar 32 for shunting the second wires b1, b2, b3, Sb4 of the three incoming lines and the outgoing line mentioned above.

This bar 32 is the homologue, for these second line wires, of the bar 23 relative to the first line wires. Its teeth 34, 36, 37, 40, 41 are the homologues of teeth 24, 25, 27, 30, 31, but they are longer, since (FIGS. 4 to 8) the bar 32 arrives, in the lower body 4, below the bar 23.

Similarly, the tuning fork contact 38 is the homologue of the tuning fork contact 28 and it likewise comprises an orifice 39 intended to receive a second test plug introduced through the corresponding orifice 42 of the cover 5.

The connection of the different line wires, incoming and outgoing, in their respective I.D.C.'s, is effected by means, for each trifilar incoming line and for the bifilar outgoing line, of a respective connection pusher 43, 44, 45, 46 which is in the form of a pivoting cover or cap which, on closing, drives the two or three line wires into their respective insulation-displacing receiver slots, finally closing by clipping at the end of stroke.

According to the present invention, the opening of each pivoting cover 43 to 46 brings about, ispo-facto, the insulation, with the respect to the other lines, of the corresponding line a1 b1, a2 b2, a3 b3, Sa4 Sb4.

Figure 4:
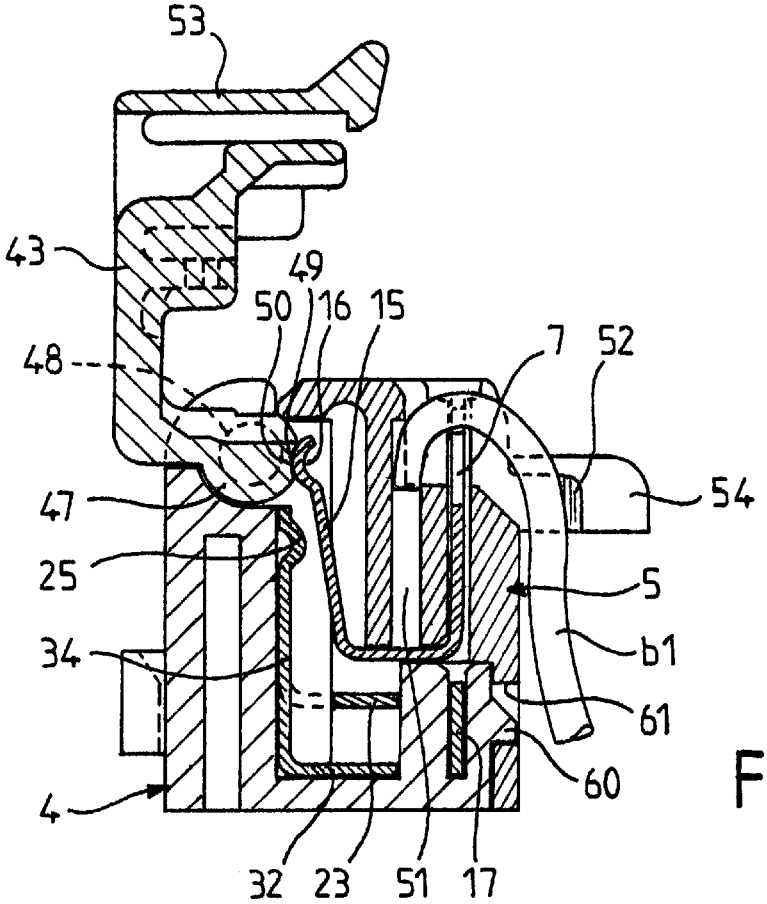
FIGS. 4 to 6 show, in section along VI—VI of FIG. 2, the successive phases of connection of a line wire and, a contrario, the functioning of this line insulation device.
Figure 5:
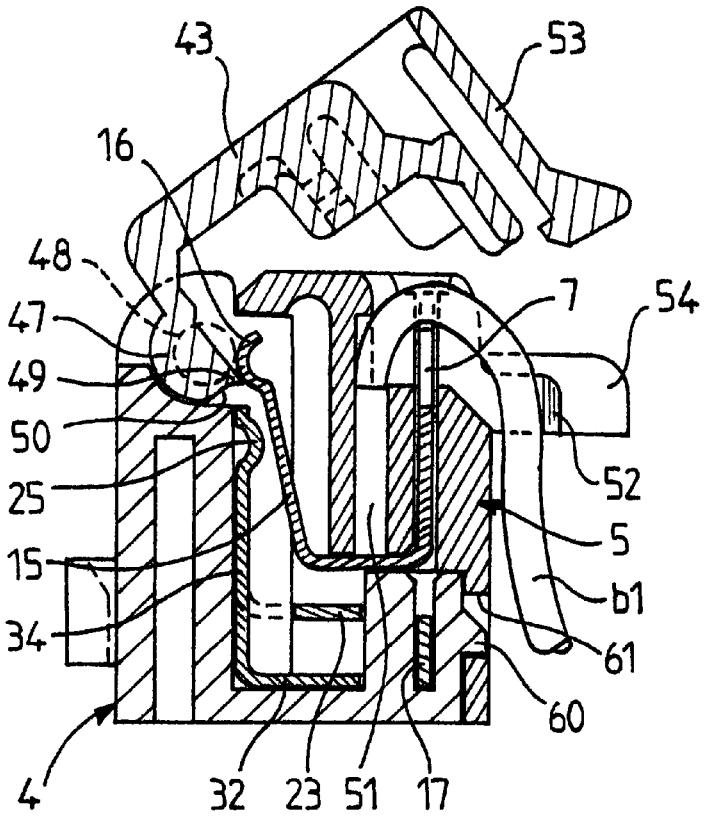
Figure 6:
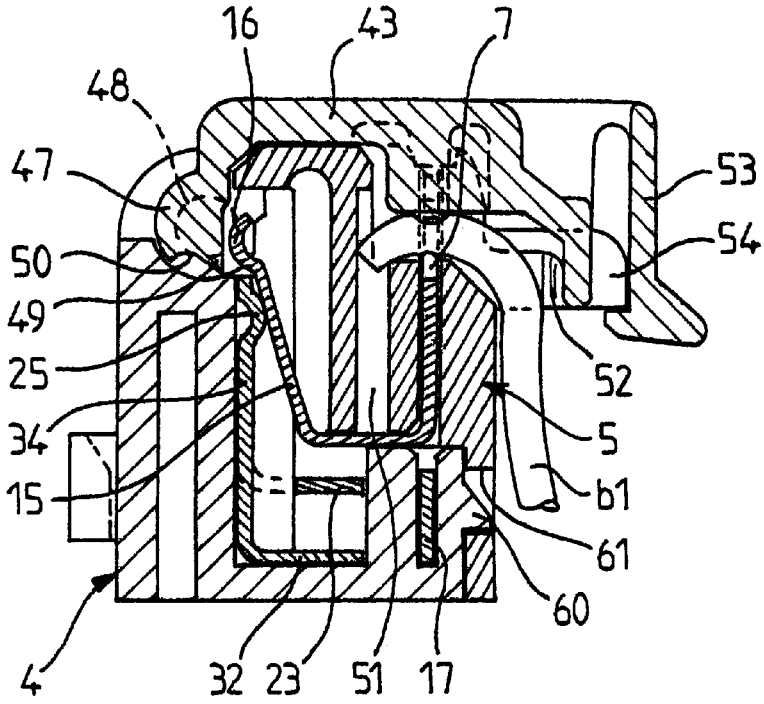

For example, by opening the pivoting cover 43, in accordance with the successive phases corresponding to FIGS. 6, 5 and 4, the two wires a1, b1 are insulated with respect to the corresponding wires of the other lines, i.e.: a2 b2, a3 b3, and Sa4, Sb4. This galvanic separation is due to a cam 47 which is bound with the pivot pin 48 of each pivoting cap, such as cap 43, and which, when this pivoting cap is raised, pushes the two associated elastic line contacts 15, thus interrupting the galvanic connection between these two line contacts and the two corresponding shunting teeth 24 and 34 respectively, for example for the two elastic contacts 15 associated with the I.D. contacts 6 and 7, as is clearly seen in these FIGS. 6, 5 and 4.

In addition, the cam 47 presents a point 49 followed by a hollow or cavity 50, with the result that, when this pivoting cover 43 is opened, the point 49 pushes (FIG. 5) the end stud 16 of the elastic arm 15 until it passes a hard point, which will be called "semi-hard" as it effects a "hard plastic 49 on elastic metal tab 15, 16" contact, after which this stud 16 "falls" into its conjugate cavity 50 (FIG. 4), which maintains the pivoting cover 43 in its position of maximum opening, galvanic continuity contact 15–34 open, without, however, it being necessary to force too much to close it on the wire b1 and its associated I.D. contact 7.

In effect, FIGS. 4, 5, 6 correspond to the reverse phases of connection of a line wire b1, this connection being effected in the following manner:

In FIG. 4, the pivoting connection pusher 43 is in its position of total opening. It is maintained in this position by the elastic thrust of the end stud 16 of the elastic arm 15, this stud 16 in that case being fitted in its conjugate receiver cavity 50 in the cam 47. In this position, the electrical contact between the end stud 25 of the tooth 34 of the shunting bar 32 and the elastic arm 15 of the I.D. contact 7 is interrupted, with the result that the two wires of line a1 b1, if they are connected in their receiver I.D. contacts 6 and 7, are electrically insulated from the other wires of line a1 b2, a3 b3, and Sa4, Sb4.

As illustrated in FIG. 4, the wire of line b1 is not yet connected in its I.D. contact 7, but simply placed in position, or "combed", ready for such connection by being driven into this contact 7. Such positioning is effected by placing the wire b1 around the I.D. contact 7, with the aid of a receiver chamber 51 at the end of this wire b1 and a holding groove 52, both being moulded in the cover 5 of the terminal block.

The pressure of hold of the rotary cover 47 in position of opening, which is exerted by the elastic arm 15, is relatively moderate, with the result that the operator has no difficulty in starting (FIG. 5) the operation of closure of the rotary cover 43 by causing the stud 16 to emerge from its conjugate cavity 50, in this starting movement, this bringing about, in the opposite direction to what has been described hereinabove, the passage of the "semi-hard" point mentioned above.

At the end of stroke (FIG. 6) of the rotary connection pusher 43, this pusher has driven the wire b1 into the insulation-displacing slot of its I.D. contact 7, and therefore effected the insulation-displacing connection of this wire. This pivoting cap 43 is blocked at the end of stroke by a flexible tongue 53 of the cap 43 clipping on a prominent bill 54 of the cover 5 of the terminal block; furthermore, this causes a clearly audible click, indicating to the assembler that the connection has been positively effected.

Finally, according to another particularity of this terminal block, there is provided (FIGS. 1 and 7) in the cover 5 and to the rear of the orifice 55 giving access to the central screw 22 for connecting the ground wire m, an inspection hole 56 which is parallel to this screw 22 and through which the end 57 of the wire m can be seen when it is introduced in the screw connector 1, which makes it possible to ensure, after having tightened this screw 22, that the ground connection m has been positively effected.

This terminal block is fixed on a receiver chassis (not shown) by means of two screws passing in two orifices 58, 59 provided to that end on the cover 5.

The cover 5 is fixed on the base 4 by clipping by means of conjugate projections 60 and slots 61, both in the front face and in the rear face, some on the base 4 and the others on the cover 5.

It goes without saying that the invention is not limited to the embodiment which has just been described. For example, the device of the invention may be used in very numerous connection members employing I.D. contacts, particularly those which are used in telephone installations.

What is claimed is:

1. A device for electrically connecting a sheathed electric wire to a corresponding line connection, the device comprising:

a rotary pusher for driving said wire into a corresponding insulation-displacing contact;

an elastic contact connecting the insulation-displacing contact and the line connection; and a cam rotated by rotation of the rotary pusher, said rotation of the cam provoking opening of the connection between the elastic contact and the line connection.

2. The device of claim 1, wherein said cam has a surface with a peak and a locking cavity defined therein, the peak and then the locking cavity contacting the elastic contact as the rotary pusher is rotated from a closed position to a maximum open position;

wherein the elastic contact is receivable in the locking cavity and the peak maintains the elastic contact in the locking cavity when the rotary pusher is in the maximum open position where the elastic contact is disconnected from the line connection;

wherein the peak and the locking cavity biases the elastic contact to define a semi-hard point during rotation of the rotary pusher between the maximum open and the closed position; and wherein rotation of the rotary pusher from the maximum open position to the closed position reestablishes connection of the elastic contact to the line connection after the peak passes the elastic contact.

3. A device for forming a disconnectable connection between an insulated wire and a line connection, the device comprising:

an insulation-displacing contact;

an elastic contact connected to the insulation-displacing contact;

a rotary pusher for driving the insulated wire into the insulation-displacing contact when rotated from an open position to a closed position; and a cam, rotated by rotation of the rotary pusher, for separating the elastic contact from the line connection when the rotary pusher is in the open position and for allowing connection of the elastic contact to the line connection when in the closed position.

4. The device according to claim 3 wherein the rotary pusher and the cam rotate about a common pivot pin.

5. The device according to claim 3 wherein the cam and the rotary pusher are integrated to form one component of the device.

6. The device according to claim 3 wherein the cam has a cam surface, the cam surface comprising a cavity and the elastic contact being biased against the cavity when the rotary pusher is in the open position to forcibly retain the rotary pusher in the open position.

7. The device according to claim 6 wherein the cam surface further comprises a peak which contacts the elastic contact before the elastic contact is positioned in the cavity as the rotary pusher is rotated from the closed position to the open position, whereby the peak acts to retain the elastic contact in the cavity.

* * * * *